US012674218B2

(12) United States Patent
Fukumoto

(10) Patent No.: US 12,674,218 B2
(45) Date of Patent: Jul. 7, 2026

(54) STEEL FOR KNIVES, STEEL FOR MARTENSITIC KNIVES, KNIFE, AND PRODUCTION METHOD FOR STEEL FOR MARTENSITIC KNIVES

(71) Applicant: Proterial, Ltd., Tokyo (JP)

(72) Inventor: Kentaro Fukumoto, Tokyo (JP)

(73) Assignee: Proterial, Ltd., Tokyo (JP)

( * ) Notice: Subject to any disclaimer, the term of this patent is extended or adjusted under 35 U.S.C. 154(b) by 700 days.

(21) Appl. No.: 17/640,339

(22) PCT Filed: Sep. 3, 2020

(86) PCT No.: PCT/JP2020/033402

§ 371 (c)(1),
(2) Date: Mar. 4, 2022

(87) PCT Pub. No.: WO2021/045143

PCT Pub. Date: Mar. 11, 2021

(65) Prior Publication Data

US 2022/0340988 A1 Oct. 27, 2022

(30) Foreign Application Priority Data

Sep. 6, 2019 (JP) ..... 2019-163378

(51) Int. Cl.

| | |
|---|---|
| ***C21D 9/18*** | (2006.01) |
| ***C21D 6/00*** | (2006.01) |
| ***C22C 38/02*** | (2006.01) |
| ***C22C 38/04*** | (2006.01) |
| ***C22C 38/24*** | (2006.01) |
| ***C22C 38/26*** | (2006.01) |
| ***C22C 38/42*** | (2006.01) |
| ***C22C 38/44*** | (2006.01) |

(52) U.S. Cl.

CPC ..... *C21D 9/18* (2013.01); *C21D 6/004* (2013.01); *C21D 6/005* (2013.01); *C21D 6/008* (2013.01); *C22C 38/02* (2013.01); *C22C 38/04* (2013.01); *C22C 38/24* (2013.01); *C22C 38/26* (2013.01); *C22C 38/42* (2013.01); *C22C 38/44* (2013.01); *C21D 2211/008* (2013.01)

(58) Field of Classification Search

CPC ..... C21D 6/004; C21D 6/005; C21D 6/008; C22C 38/02; C22C 38/04; C22C 38/24; C22C 38/26

See application file for complete search history.

(56) References Cited

U.S. PATENT DOCUMENTS

| | | | |
|---|---|---|---|
| 3,469,972 A | 9/1969 | Flaherty et al. | |
| 3,672,877 A | 6/1972 | Jan-Christer et al. | |
| 3,926,622 A | 12/1975 | Kiyonaga et al. | |
| 6,053,991 A | 4/2000 | Yokoi et al. | |
| 2002/0139454 A1 | 10/2002 | Komori et al. | |

FOREIGN PATENT DOCUMENTS

| | | | |
|---|---|---|---|
| GB | 1382767 | 2/1975 | |
| JP | S53114719 | 10/1978 | |
| JP | H0539547 | 2/1993 | |
| JP | H0978199 | 3/1997 | |
| JP | H1060596 | 3/1998 | |
| JP | 2000282179 | 10/2000 | |
| JP | 2001172748 | 6/2001 | |
| JP | 2001172748 A * | 6/2001 | |
| JP | 2002212679 | 7/2002 | |
| JP | 2002285297 | 10/2002 | |
| JP | 2002285297 A * | 10/2002 | ..... C21D 6/04 |
| JP | 2007197784 | 8/2007 | |
| JP | 2011026693 | 2/2011 | |
| KR | 20090069608 | 7/2009 | |

OTHER PUBLICATIONS

"International Search Report (Form PCT/ISA/210) of PCT/JP2020/033402", mailed on Oct. 27, 2020, with English translation thereof, pp. 1-6.
"Office Action of Korea Counterpart Application", issued on Dec. 1, 2023, with English translation thereof, p. 1-p. 8.
"Search Report of Europe Counterpart Application", issued on Aug. 28, 2023, pp. 1-12.
Office Action of China Counterpart Application, with English translation thereof, issued on Apr. 20, 2023, pp. 1-9.
"Office Action of India Counterpart Application", issued on May 18, 2022, with English translation thereof, p. 1-p. 5.
Office Action of China Counterpart Application, with English translation thereof, issued on Jul. 22, 2022, pp. 1-15.
"Notice of Final Rejection of Korea Counterpart Application", issued on Oct. 15, 2024, with English translation thereof, p. 1-p. 8.
"Office Action of Korea Counterpart Application", issued on Jun. 26, 2024, with English translation thereof, pp. 1-8.

* cited by examiner

*Primary Examiner* — Anthony M Liang
(74) *Attorney, Agent, or Firm* — JCIPRNET

(57) ABSTRACT

Provided are: steel for knives, having a higher hardness and better corrosion resistance than conventional steel for knives; a knife; steel for martensitic knives; and a production method for same. The steel for knives comprises a component composition containing, in mass %, 0.45%-1.00% C, 0.1%-1.5% Si, 0.1%-1.5% Mn, 7.5%-11.0% Cr, and 0.5%-3.0% of either Mo or W or a complex of both (Mo+W/2), with the remainder being Fe and unavoidable impurities. Also provided are steel for martensitic knives and a knife. A production method for steel for martensitic knives is also provided that includes a quenching temperature at quenching of 1,050-1,250° C., a processing temperature for subzero processing of no more than −50° C., and a tempering temperature at tempering of 100-400° C., and obtains steel for martensitic knives that has a hardness of at least 700 HV.

7 Claims, 2 Drawing Sheets

10μm

10μm

STEEL FOR KNIVES, STEEL FOR MARTENSITIC KNIVES, KNIFE, AND PRODUCTION METHOD FOR STEEL FOR MARTENSITIC KNIVES

CROSS-REFERENCE TO RELATED APPLICATION

This application is a 371 application of the International PCT application serial no. PCT/JP2020/033402, filed on Sep. 3, 2020, which claims the priority benefits of Japan Patent Application No. 2019-163378, filed on Sep. 6, 2019. The entirety of each of the above-mentioned patent applications is hereby incorporated by reference herein and made a part of this specification.

TECHNICAL FIELD

The present invention relates to a steel for knives, a steel for martensitic knives, a knife, and a method of producing a steel for martensitic knives.

BACKGROUND ART

In the related art, high-strength carbon steels equivalent to SK1 and martensitic stainless steels containing 12 to 13% of Cr have been used as steels for knives such as cutters and razors. The former steels can be given high hardness through a quenching and tempering heat treatment, but they have poor corrosion resistance, and thus can be used only for minor uses. On the other hand, the latter martensitic stainless steels can not only be given high hardness through quenching and tempering, but also have excellent corrosion resistance, and therefore do not easily rust and can generally be applied in a widely variety of uses.

The sharpness of a knife is mainly determined by the hardness of the cutting edge, the angle at which the blade is attached, and the distribution state of hard particles, and the hardness is a particularly essential characteristic for improving the sharpness. On the other hand, the corrosion resistance of a knife is mainly determined by the content of Cr and Mo. Therefore, in order to improve the sharpness of a knife and improve the corrosion resistance, it is essential to increase the hardness of the knife after quenching, tempering and increase the content of Cr and Mo. However, the method of increasing the content of Cr and Mo has a problem that the hardness of the knife after quenching and tempering decreases because the amount of austenite remaining during quenching increases. In order to address this problem, in Patent Literature 1, for example, the applicants proposed a steel for stainless steel razors having a component composition including, in mass %, C: 0.55 to 0.73%, Si: 1.0% or less, Mn: 1.0% or less, and Cr: 12 to 14%, with the remainder being Fe and impurities, and with a carbide density of 140 to 600 pieces/100 $\mu m^2$ in the annealed state in a continuous furnace, as a way of improving short-time hardenability of a martensitic stainless steel and obtaining high hardness. In addition, Patent Literature 2 proposes a steel for stainless steel razors containing, in mass %, C: 0.55 to 0.85%, Si: 2.0% or less, Mn: 1.0% or less, Cr: 8 to 15%, and N: 0.03% or less, further containing any one or two groups of one group of 3.0% or less of one or two or more of W, V, Mo, and Co, and one group of 2.0% or less of one or two of Ni and Cu, and with the remainder being Fe and some impurities, and having a high heat treatment hardness.

CITATION LIST

Patent Literature

[Patent Literature 1]
Japanese Patent Laid-Open No. H5-39547
[Patent Literature 2]
Japanese Patent Laid-Open No. S53-114719

SUMMARY OF INVENTION

Technical Problem

In recent years, in order to meet the demands for further improvement in sharpness and shaving performance, a knife having a higher hardness and higher corrosion resistance than in the related art has been required. Patent Literature 1 describes a razor steel having a high hardness of 660 to 720 HV after tempering and favorable corrosion resistance obtained by performing quenching, subzero processing, and a tempering treatment on a finely dispersed annealed material with a carbide density of 560 pieces/100 $\mu m^2$. In addition, Patent Literature 2 describes a stainless steel for razors having a tempering hardness of 620 to 716 HV, but the steels described in Patent Literature 1 and 2 are not enough to meet the demands for higher hardness and higher corrosion resistance, and there is still room for further examination. In view of the above circumstances, an objective of the present invention is to provide a steel for knives having a higher hardness and better corrosion resistance than in the related art. In addition, an objective of the present invention is to provide a production method in which a steel for knives having a high hardness and excellent corrosion resistance can be obtained without adding a process of increasing the number density of carbide pieces.

Solution to Problem

The present invention has been made in view of the above problems.

That is, an aspect of the present invention is a steel for knives having a component composition including, in mass %, C: 0.45 to 1.00%, Si: 0.1 to 1.5%, Mn: 0.1 to 1.5%, and Cr: 7.5 to 11.0%, and (Mo+W/2) for Mo and W alone or in combination: 0.5 to 3.0% and with the remainder being Fe and unavoidable impurities.

Preferably, the steel for knives further includes, in mass %, (V+Nb) for V and Nb alone or in combination: 0.5% or less, or further includes, in mass %, (Ni+Cu) for Ni and Cu alone or in combination: 0.5% or less.

Another aspect of the present invention is a steel for martensitic knives having a component composition of the steel for knives and having a hardness of 700 HV or more.

Preferably, a carbide area ratio in a cross-sectional structure is 8.0% or less, and an average of equivalent circle diameters of carbides is 0.2 to 0.8 μm.

Another aspect of the present invention is a knife using the steel for martensitic knives.

Another aspect of the present invention is a method of producing a steel for martensitic knives, including performing quenching, subzero processing, and tempering on the steel for knives of the above component composition, setting a quenching temperature during the quenching to 1,050 to 1,250° C., setting a processing temperature during the subzero processing to −50° C. or lower, setting a tempering temperature during the tempering to 100 to 400° C., and obtaining a steel for martensitic knives having a hardness of 700 HV or more.

Preferably, the tempering temperature is set to 100 to 160° C., and a steel for martensitic knives having a hardness of 800 HV or more is thus obtained.

Advantageous Effects of Invention

According to the present invention, it is possible to more efficiently obtain a steel for knives, which has higher hardness and better corrosion resistance than in the related art.

DESCRIPTION OF EMBODIMENTS

Figure 1:
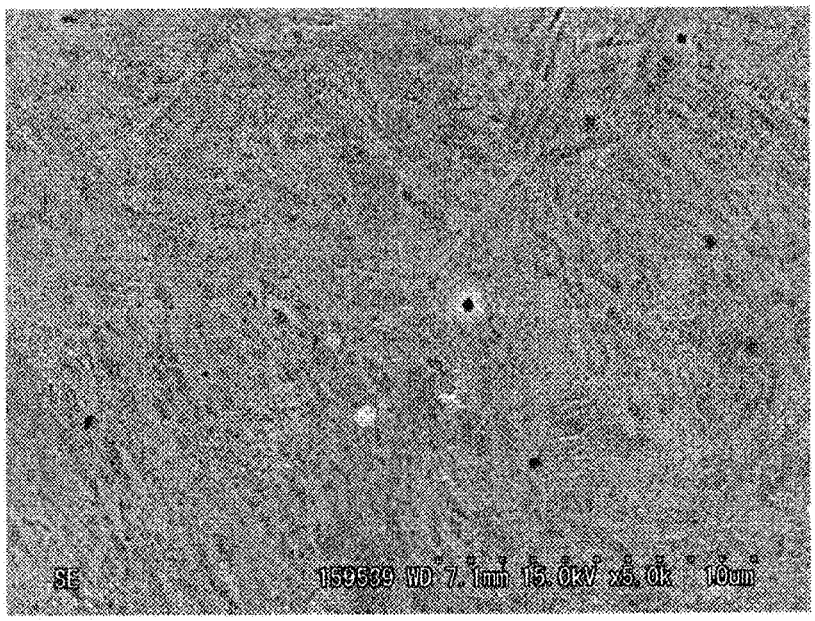
FIG. 1 is a scanning electron microscope image showing a cross-sectional structure of a steel for martensitic knives of a present invention example.

Hereinafter, one embodiment of the present invention will be described. However, the present invention is not limited to the embodiments exemplified here, and appropriate combinations and improvements are possible without departing from the technical ideas of the invention. First, the reason for limitation of the component composition of a steel for knives according to the present invention will be described.

C: 0.45 to 1.00%

C is an important element that solid-solutionizes carbides into a base (matrix) at an austenitic temperature during quenching and determines the hardness of martensite produced by quenching. Here, C in steel is divided into that which is solid-solutionized in a base and that which is precipitated as carbides, but the ratio therebetween is determined by the interaction with Cr, and thus it is important to keep Cr within a composition range to be described below. In order to obtain a steel for martensitic knives having a higher hardness suitable for the present invention, the lower limit of C is 0.45%. The lower limit value of C is preferably 0.50%, more preferably 0.55%, still more preferably 0.58%, and particularly preferably 0.60%. On the other hand, if the amount of C is too large, large eutectic carbides that cause blade chipping may be generated. In addition, if the amount of C is too large, the amount of carbides generated also becomes excessive, which causes a decrease in the amount of Cr and Mo solid-solutionized in martensite, and a decrease in corrosion resistance, and thus the upper limit of C is 1.00%. The upper limit value of C is preferably 0.95%, more preferably 0.90%, still more preferably 0.85%, and particularly preferably 0.79%.

Si: 0.1 to 1.5%

Si is an element that is used as a deoxidizing agent when a steel for knives is refined and is also solid-solutionized in steel and inhibits softening during low temperature tempering, and thus the lower limit thereof is 0.1%. On the other hand, since an excessive content thereof lowers the toughness of the steel for knives, for example, cold processability during cold rolling may deteriorate. Therefore, the upper limit of the amount of Si is 1.5%. The upper limit is preferably 1.2%, more preferably 1.0%, still more preferably 0.98%, and particularly preferably 0.95.

Mn: 0.1 to 1.5%

Like Si, Mn is an element that has a role as a deoxidizing agent during refining, and is solid-solutionized in a base and improves hardenability. If the amount of Mn is too small, since hardenability of the steel deteriorates, and the steel may not be hardened particularly in the center part of the wall thickness, the lower limit is 0.1%. On the other hand, since an excessive content of Mn lowers hot processability, the upper limit is 1.5%. The upper limit is preferably 1.2%, and more preferably 1.0%.

Cr: 7.5 to 11.0%

Cr is an element important for forming a strong passive film in steel and obtaining excellent corrosion resistance. In order to exhibit this corrosion resistance, it is necessary for the steel to contain at least 7.5% of Cr. The lower limit of Cr is preferably 8.0%, more preferably 8.5%, and still more preferably 9.0%. On the other hand, an excessive amount of Cr causes a decrease in the martensitic transformation start temperature (Ms point), and causes a decrease in hardness due to an increase in the residual austenite. In order to achieve both high hardness and favorable corrosion resistance, the upper limit of Cr is 11.0%. The upper limit of Cr is preferably 10.5%, and more preferably 10.2%.

Mo+W/2: 0.5 to 3.0%

Mo and W have the same effect, and are specified by (Mo+W/2) from the relationship of atomic weight therebetween. Here, Mo and W can be contained singly or in combination. Mo and W are elements that have a strong effect of stabilizing passivation and are effective for improving corrosion resistance by making a pitting potential in a chloride solution high. In addition, they are elements that inhibit softening in low-temperature tempering, and at least 0.5% is required to obtain these effects. On the other hand, since an excessive added amount of Mo and W significantly lowers processability during hot processing, the upper limit is 3.0%. The lower limit of the amount of (Mo+W/2) is preferably 0.8%, and the upper limit of the amount of (Mo+W/2) is preferably 2.0%.

Preferably, Nb+V: 0.5% or Less

Nb and V have the same effect, and can be contained singly or in combination. Nb has a high affinity for carbon, and forms thermally stable carbide. Since this carbide is extremely thermally stable, it does not dissolve in high-temperature austenite but remains, and inhibits coarsening of austenite according to pinning of the carbide. In addition, similarly, V is an element that finely disperses thermally stable carbide, inhibits coarsening of austenite, and improves abrasion resistance. However, since a carbide containing Nb and V is thermally stable, it does not dissolve in high-temperature austenite but remains, which reduces the amount of carbon that solid-solutionizes in martensite and leads to a decrease in hardness. In addition, if the content is large, there is a high likelihood of cracks occurring due to a decrease in cold processability. Therefore, if V and Nb are contained in the present embodiment, the upper limit of the amount of (V+Nb) is 0.5%. The upper limit of the amount of (V+Nb) is preferably 0.4%, and the upper limit of the amount of (V+Nb) is more preferably 0.3%.

Preferably, Ni+Cu: 0.5% or Less

Ni and Cu are elements that are effective for improving corrosion resistance with respect to non-oxidizing acids such as sulfuric acid, and can be contained singly or in combination. However, they cause a decrease in the Ms point and cause a decrease in hardness due to an increase in the residual austenite. Therefore, if Ni+Cu are contained, the upper limit of the amount of (Ni+Cu) is 0.5%. The upper limit of the amount of (Ni+Cu) is preferably 0.4%, and the upper limit of the amount of (Ni+Cu) is more preferably 0.3%.

The steel for knives according to the present invention can contain the following elements.

Co: 0.5% or Less

Co is an element that solid-solutionizes in martensite and improves tempering softening resistance. On the other hand, for applications in which contact with the human body is possible, such as a razor material, since Co may cause metal allergies, the steel of the present embodiment may contain Co in a range of 0.5% or less.

N is an element that solid-solutionizes in the martensite structure and improves corrosion resistance, but it causes a decrease in the Ms point and causes a decrease in hardness due to an increase in residual austenite. Therefore, the steel of the present embodiment may contain N in a range of 0.1% or less. The upper limit is preferably 0.07%, and more preferably 0.05%.

In the present embodiment, components other than the above components are Fe and unavoidable impurities. Examples of unavoidable impurity elements include P, S, Al, Ti, N and O, and they may be contained in the following ranges as long as the effects of the present invention are not impaired.

P≤0.04%, S≤0.03%, Al≤0.1%, Ti≤0.1%, and O≤0.05%.

Subsequently, an embodiment of the steel for martensitic knives of the present invention will be described.

When quenching, subzero processing, and tempering are performed on the steel for knives having the above component composition, a steel for martensitic knives having a very high hardness can be obtained. The hardness of the steel for martensitic knives of the present embodiment as a value measured at room temperature (normal temperature) is 700 HV or more. The hardness is preferably 720 HV or more, more preferably 735 HV or more, still more preferably 770 HV or more, and particularly preferably 800 HV or more. The upper limit is not particularly limited, and it may be about 950 HV due to production restrictions. Here, a steel for knives before quenching can be produced by performing annealing such as batch annealing and continuous annealing on a hot rolled component having the above component composition, and cold processing (for example, cold rolling) one or more times on the material for cold rolling after annealing.

When the steel for martensitic knives of the present embodiment contains carbides, a carbide area ratio in the cross-sectional structure is preferably 8.0% or less. When the carbide area ratio is within the above range, excellent corrosion resistance can be obtained. The upper limit of the carbide area ratio is more preferably 6.0%, still more preferably 4.0%, yet more preferably 2.0%, particularly preferably 1.0%, and most preferably 0.8%. In addition, as described above, since coarse carbides cause a decrease in knife strength, the average of the equivalent circle diameters (area equivalent circle diameters) of the carbides in the cross-sectional structure is preferably 0.2 to 0.8 μm. The upper limit of the average of the equivalent circle diameter is more preferably 0.6 μm, and the upper limit of the average of the equivalent circle diameter is still more preferably 0.5 μm.

Here, the average of the carbide area ratio and the equivalent circle diameter in the present embodiment can be calculated by observing carbides with a field of view of 500 $\mu m^2$ or more in a field of view area imaged with a scanning electron microscope (a magnification of 5,000) and performing image analysis thereon in a cross-sectional structure parallel to the processing direction (the extension direction of rolling processing) of the steel for martensitic knives. Here, image analysis target carbides are limited to those having an equivalent circle diameter of 0.1 μm or more, and those having an equivalent circle diameter smaller than that are not targeted. In addition, identification of carbides can be confirmed by elemental mapping by an electron probe micro analyzer (EPMA) attached to the scanning electron microscope. When processing is performed on the steel for martensitic knives having the above characteristics, it is possible to obtain a knife having favorable sharpness and excellent corrosion resistance.

Subsequently, a method of producing a steel for martensitic knives of the present invention will be described. In the present invention, quenching, subzero processing, and tempering are performed on the steel for knives having the above component range. The quenching temperature is 1,050 to 1,250° C., the processing temperature during subzero processing is −50° C. or lower, and the tempering temperature during tempering is 100 to 400° C. In this component system, if the quenching temperature is less than 1,050° C., since carbides are not sufficiently solid-solutionized in austenite, the hardness becomes low. In addition, if the quenching temperature exceeds 1,250° C., excessively solid-solutionized carbon causes quench cracking after quenching or in subzero processing. Therefore, the quenching temperature is 1,050 to 1,250° C. The lower limit of the quenching temperature is preferably 1,100° C., and the lower limit is more preferably 1,150° C. In addition, the upper limit of the quenching temperature is preferably 1,230° C., and the upper limit is more preferably 1,210° C.

The temperature during subzero processing performed after the quenching process is −50° C. or lower. When the temperature is adjusted to this range, it is easy to obtain a characteristic of high hardness, which is a characteristic of the present invention. Although the lower limit is not particularly set, for example, the lower limit may be −196° C., assuming a treatment with liquid nitrogen. In the subzero processing of the present embodiment, a mixed solution containing dry ice at −75° C. and an alcohol is used, but liquefied carbon dioxide or liquid nitrogen may be used. In addition, an electric freezing instrument may be used, or a gas such as carbon dioxide gas may be used.

In the production method of the present embodiment, tempering is performed after the subzero processing process. When the tempering temperature is set to 100 to 400° C., a steel for martensitic knives having a hardness of 700 HV or more can be obtained. In this component system, if the tempering temperature is less than 100° C., the toughness tends to be excessively low. On the other hand, if the tempering temperature exceeds 400° C., a large amount of carbides is precipitated from the martensite structure, which causes a decrease in hardness. The upper limit of the tempering temperature is preferably 350° C. In addition, in order to obtain a steel for martensitic knives having a higher hardness, it is preferable to set the tempering temperature to 100° C. to 160° C. The upper limit of the tempering temperature is more preferably 150° C. Thereby, it is possible to further reduce precipitation of carbides, and it is possible to obtain a steel for martensitic knives having a high hardness of 800 HV or more.

EXAMPLES

Hot rolled components having a component composition (the remainder being Fe and unavoidable impurities) shown in Table 1 and a thickness of 2.0 mm were annealed in a batch type annealing furnace, cold rolling and annealing were then repeated, finishing was performed at a thickness of 0.1 mm, and thereby Present Invention Examples 1 to 16, and Comparative Examples 1 to 13 were prepared.

Figure 3:
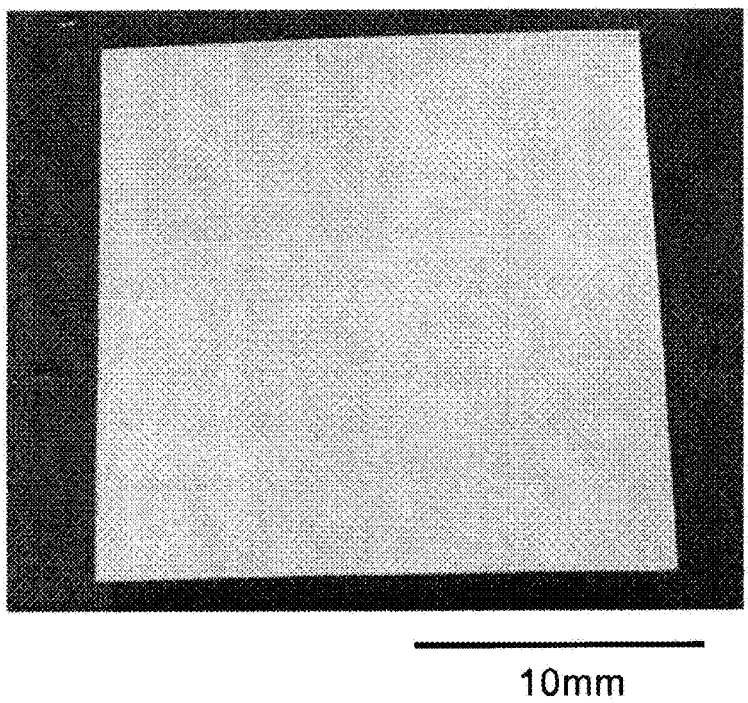
FIG. 3 is an image showing the results of a salt spray test for a steel for martensitic knives of a present invention example.
Figure 4:
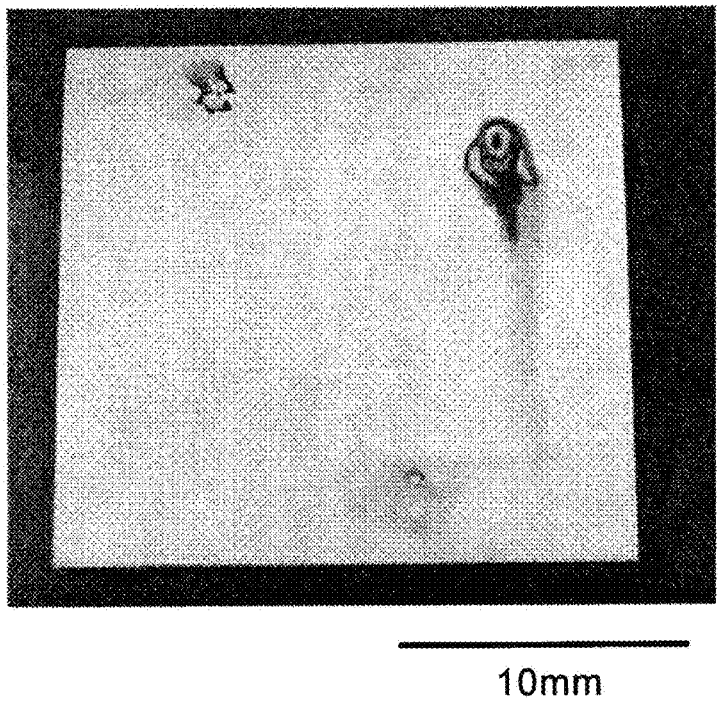
FIG. 4 is an image showing the results of a salt spray test for a steel for martensitic knives of a comparative example.

Subsequently, the hardness after the heat treatment and the corrosion resistance were examined. Regarding the hardness, the samples of the present invention examples and the comparative examples were heated in an Ar atmosphere at 1,100 to 1,200° C., and then quenched by rapid cooling, and then subjected to subzero processing at −75° C. for 15 minutes, and tempered at a temperature of 150° C. and 350° C. Three types of hardness were measured during quenching, during tempering at 150° C., and during tempering at 350° C. Regarding the corrosion resistance, a salt spray test (based on JIS-Z-2371: 2015) using a 5% neutral saline solution at 35° C. was performed on the sample tempered at 350° C., and the state of rusting after 1 h was evaluated based on the rusting area ratio. In this example, it was determined as ○ (no rust) when the area ratio of rust was less than 1%, and x (rust) when the area ratio was 1% or more. Table 2 shows the hardness thereof. In addition, FIG. 3 shows the salt spray test results of Present Invention Example 1 as a representative example, and FIG. 4 shows the salt spray test results of Comparative Example 1.

TABLE 1

| | Chemical composition (mass %)* | | | | | | | | | |
|---|---|---|---|---|---|---|---|---|---|---|
| | C | Si | Mn | Cr | Mo | W | V | Nb | Cu | Ni |
| Present Invention Example 1 | 0.64 | 0.90 | 0.69 | 10.1 | 1.0 | — | — | — | — | — |
| Present Invention Example 2 | 0.63 | 0.93 | 0.73 | 10.0 | — | 2.0 | — | — | — | — |
| Present Invention Example 3 | 0.65 | 0.90 | 0.70 | 10.0 | 2.0 | — | — | — | — | — |
| Present Invention Example 4 | 0.79 | 0.29 | 0.51 | 9.1 | 2.0 | — | — | — | — | — |
| Present Invention Example 5 | 0.71 | 0.92 | 0.65 | 10.0 | 2.0 | — | 0.3 | — | — | — |
| Present Invention Example 6 | 0.70 | 0.91 | 0.74 | 10.1 | 1.0 | — | 0.1 | — | — | — |
| Present Invention Example 7 | 0.63 | 0.77 | 0.75 | 9.0 | 1.0 | — | 0.2 | 0.1 | — | — |
| Present Invention Example 8 | 0.71 | 0.48 | 0.73 | 10.0 | 1.3 | — | — | — | 0.2 | 0.2 |
| Present Invention Example 9 | 0.61 | 1.04 | 1.02 | 10.0 | 0.8 | — | — | — | — | — |
| Present Invention Example 10 | 0.63 | 0.90 | 0.68 | 8.0 | 2.0 | — | — | — | — | — |
| Present Invention Example 11 | 0.95 | 0.28 | 0.71 | 9.1 | 1.0 | — | — | — | — | — |
| Present Invention Example 12 | 0.81 | 0.27 | 0.72 | 9.1 | 1.0 | — | — | 0.1 | — | — |
| Present Invention Example 13 | 0.64 | 0.28 | 0.71 | 10.1 | 2.0 | — | — | — | — | — |
| Present Invention Example 14 | 0.49 | 0.90 | 0.73 | 9.0 | 2.1 | — | — | — | — | — |

TABLE 1-continued

| | Chemical composition (mass %)* | | | | | | | | | |
|---|---|---|---|---|---|---|---|---|---|---|
| | C | Si | Mn | Cr | Mo | W | V | Nb | Cu | Ni |
| Present Invention Example 15 | 0.70 | 0.49 | 0.72 | 9.0 | 1.0 | — | — | — | — | — |
| Present Invention Example 16 | 0.80 | 0.27 | 0.69 | 9.0 | 1.0 | — | — | — | — | — |
| Comparative Example 1 | 0.69 | 0.28 | 0.66 | 13.3 | — | — | — | — | — | — |
| Comparative Example 2 | 0.63 | 0.91 | 0.74 | 6.9 | 2.0 | — | — | — | — | — |
| Comparative Example 3 | 0.62 | 0.48 | 0.84 | 13.7 | 1.3 | — | — | — | — | — |
| Comparative Example 4 | 0.63 | 0.90 | 0.75 | 6.2 | 2.9 | — | — | — | — | — |
| Comparative Example 5 | 0.50 | 0.51 | 0.72 | 11.2 | 0.3 | — | — | — | — | — |
| Comparative Example 6 | 1.05 | 0.31 | 0.43 | 9.0 | 1.4 | — | — | — | — | — |
| Comparative Example 7 | 0.71 | 0.29 | 0.64 | 9.1 | — | — | — | — | — | — |
| Comparative Example 8 | 0.63 | 0.93 | 0.73 | 10.1 | 2.0 | — | 0.7 | — | — | — |
| Comparative Example 9 | 0.63 | 0.93 | 0.75 | 10.1 | 2.0 | — | — | 0.7 | — | — |
| Comparative Example 10 | 0.61 | 0.57 | 0.79 | 9.8 | 1.3 | — | 0.3 | 0.3 | — | — |
| Comparative Example 11 | 0.63 | 0.90 | 0.72 | 10.1 | 2.0 | — | — | — | 0.7 | — |
| Comparative Example 12 | 0.64 | 0.92 | 0.72 | 10.1 | 2.0 | — | — | — | — | 0.7 |
| Comparative Example 13 | 0.61 | 0.53 | 0.70 | 10.4 | 1.2 | — | — | — | 0.3 | 0.3 |

*the remainder is composed of Fe and unavoidable impurities (P ≤ 0.04%, S ≤ 0.03%, Al ≤ 0.1%, Ti ≤ 0.1%, O ≤ 0.05%)

TABLE 2

| | Quenching hardness (HV) | Tempering harness at 150° C. (HV) | Tempering harness at 350° C. (HV) | Rusting area ratio (%) | Presence of rust |
|---|---|---|---|---|---|
| Present Invention Example 1 | 847 | 866 | 742 | 0.6 | ○ |
| Present Invention Example 2 | 843 | 861 | 745 | 0.9 | ○ |
| Present Invention Example 3 | 829 | 848 | 741 | 0 | ○ |
| Present Invention Example 4 | 923 | 930 | 737 | 0.2 | ○ |
| Present Invention Example 5 | 836 | 839 | 748 | 0.1 | ○ |
| Present Invention Example 6 | 834 | 813 | 746 | 0.5 | ○ |
| Present Invention Example 7 | 827 | 807 | 743 | 0.8 | ○ |
| Present Invention Example 8 | 848 | 827 | 720 | 0.3 | ○ |
| Present Invention Example 9 | 821 | 811 | 744 | 0.4 | ○ |
| Present Invention Example 10 | 823 | 830 | 726 | 0.7 | ○ |
| Present Invention Example 11 | 891 | 915 | 723 | 1.0 | ○ |
| Present Invention Example 12 | 867 | 895 | 736 | 0.2 | ○ |
| Present Invention Example 13 | 862 | 896 | 704 | 0.1 | ○ |
| Present Invention Example 14 | 813 | 824 | 703 | 0 | ○ |
| Present Invention Example 15 | 847 | 869 | 713 | 0.2 | ○ |
| Present Invention Example 16 | 878 | 919 | 728 | 0.8 | ○ |

TABLE 2-continued

| | Quenching hardness (HV) | Tempering harness at 150° C. (HV) | Tempering harness at 350° C. (HV) | Rusting area ratio (%) | Presence of rust |
|---|---|---|---|---|---|
| Comparative Example 1 | 812 | 796 | 675 | 3.2 | x |
| Comparative Example 2 | 879 | 873 | 764 | 12.0 | x |
| Comparative Example 3 | 754 | 704 | 621 | 0 | ○ |
| Comparative Example 4 | 884 | 881 | 757 | 20.3 | x |
| Comparative Example 5 | 791 | 782 | 672 | 4.7 | x |
| Comparative Example 6 | 912 | 894 | 747 | 6.8 | x |
| Comparative Example 7 | 897 | 902 | 692 | 6.4 | x |
| Comparative Example 8 | — | — | — | — | — |
| Comparative Example 9 | — | — | — | — | — |
| Comparative Example 10 | — | — | — | — | — |
| Comparative Example 11 | 787 | 761 | 691 | 0.2 | ○ |
| Comparative Example 12 | 774 | 752 | 673 | 0.3 | ○ |
| Comparative Example 13 | 783 | 749 | 656 | 0.8 | ○ |

Based on the results of Table 2, in Present Invention Examples 1 to 16, the quenching hardness was 800 HV or more, the tempering hardness at 350° C. was 700 HV or more, the tempering hardness at 150° C. was 800 HV or more, the rusting area ratio was 1% or less, and both the hardness and the corrosion resistance were good. On the other hand, in the results of Comparative Examples 1 and 5, the corrosion resistance was also low, and the quenching hardness and the tempering hardness were also lower than those of the present invention examples. It was confirmed that all of Comparative Examples 2, 4, 6, and 7 had a high rusting area ratio and a low corrosion resistance. In Comparative Examples 3, and 11 to 13, the rusting area ratio was less than 1%, and although the corrosion resistance was high, the tempering hardness at 350° C. was a low value of less than 700 HV. Thereby, it was confirmed that the present invention examples having both higher hardness and better corrosion resistance than the conventional examples were obtained. Here, in Comparative Examples 8 to 10 in which the amount of V+Nb was 0.6% or more, the evaluation was stopped because a plurality of cracks were formed in the end surface of the sample and in the inside of the sample from an early stage of the cold rolling process.

Figure 2:
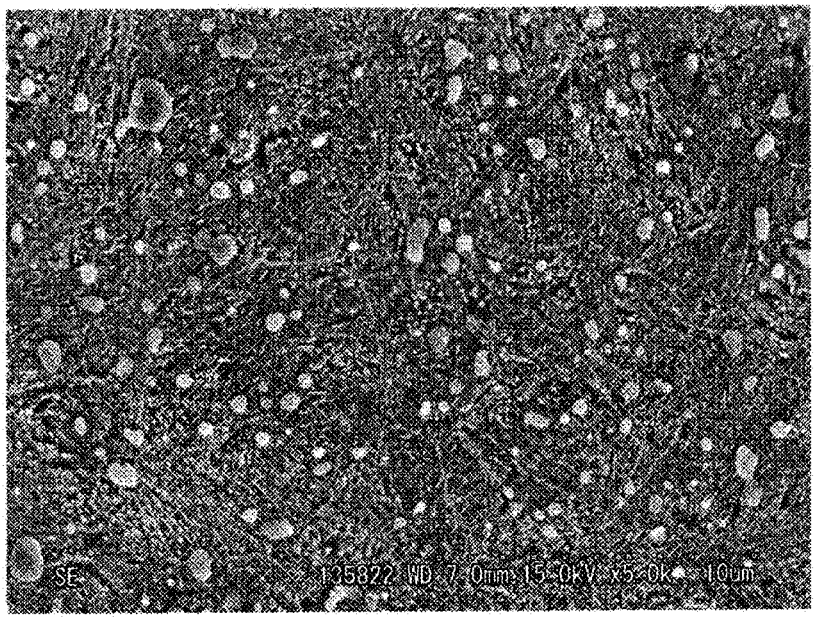
FIG. 2 is a scanning electron microscope image showing a cross-sectional structure of a steel for martensitic knives of a comparative example.

Subsequently, observation samples were collected from the produced Present Invention Examples 1, 15 and 16, and Comparative Example 1, and the average of the equivalent circle diameters of carbides and the carbide area ratio were measured. The area ratio and the equivalent circle diameter were measured using an image analysis device from carbides having an equivalent circle diameter of 0.1 μm or more with a field of view area of 500 $\mu m^2$ or more in a field of view imaged with a scanning electron microscope (a magnification of 5,000) in a cross-sectional structure parallel to the extension direction of rolling processing of the steel for martensitic knives. FIG. 1 shows a microscope image of Present Invention Example 1, FIG. 2 shows a microscope image of Comparative Example 1, and Table 3 shows the measurement results.

TABLE 3

| | Average equivalent circle diameter of carbide (μm) | Carbide area ratio (%) |
|---|---|---|
| Present Invention Example 1 | 0.5 | 0.3 |
| Present Invention Example 15 | 0.4 | 3.9 |
| Present Invention Example 16 | 0.4 | 5.5 |
| Comparative Example 1 | 0.5 | 8.5 |

As a result of measurement, the average of the equivalent circle diameters of carbides of the present invention example was 0.4 to 0.5 μm, and the carbide area ratio was 5.5% or less. On the other hand, it was confirmed that the average of the equivalent circle diameters of carbides of Comparative Example 1 was 0.5 μm, which was the same level as that of the present invention example, but the carbide area ratio was 8.5%, which was larger than that of the sample of the present invention.

The invention claimed is:

1. A steel for martensitic knives having a component composition comprising:

in mass %, C: 0.55 to 0.95%, Si: 0.1 to 0.95%, Mn: 0.1 to 1.5%, and Cr: 9.0 to 10.2%, and (Mo+W/2) for Mo and W alone or in combination: 0.5 to 3.0%, and with a remainder being Fe and unavoidable impurities, and having a hardness of 800 HV or more.

2. The steel for martensitic knives according to claim 1, further comprising:

in mass %, (V+Nb) for V and Nb alone or in combination: 0.5% or less.

3. The steel for martensitic knives according to claim 1, further comprising:

in mass %, (Ni+Cu) for Ni and Cu alone or in combination: 0.5% or less.

4. The steel for martensitic knives according to claim 1, wherein a carbide area ratio in a cross-sectional structure is 8.0% or less, and an average of equivalent circle diameters of carbides is 0.2 to 0.8 μm.

5. A knife comprising the steel for martensitic knives according to claim 1.

6. A method of producing the steel for martensitic knives according to claim 1, comprising:

performing quenching, subzero processing, and tempering on a steel material having the component composition of the steel for martensitic knives according to claim 1;

setting a quenching temperature during the quenching to 1,050 to 1,250° C., setting a processing temperature during the subzero processing to −50° C. or lower, and setting a tempering temperature during the tempering to 100 to 160° C.; and obtaining the steel for martensitic knives having a hardness of 800 HV or more.

7. The steel for martensitic knives according to claim 2, further comprising:

in mass %, (Ni+Cu) for Ni and Cu alone or in combination: 0.5% or less.

* * * * *